US006178589B1

(12) United States Patent
Kaim

(10) Patent No.: US 6,178,589 B1
(45) Date of Patent: Jan. 30, 2001

(54) WEB CLEANER TRACK ASSEMBLY

(75) Inventor: Wayne K. Kaim, Lodi, WI (US)

(73) Assignee: Kaim & Associates International Marketing, Inc., Lodi, WI (US)

( * ) Notice: Under 35 U.S.C. 154(b), the term of this patent shall be extended for 0 days.

(21) Appl. No.: 09/484,572

(22) Filed: Jan. 18, 2000

(51) Int. Cl.[7] ..... B08B 5/02

(52) U.S. Cl. ..... 15/308; 15/256.5; 15/309.1; 101/425

(58) Field of Search ..... 15/301, 308, 309.1, 15/256.5; 101/425

(56) References Cited

U.S. PATENT DOCUMENTS

| | | | | |
|---|---|---|---|---|
| 1,089,453 | * | 3/1914 | Wood | 101/425 |
| 3,078,496 | * | 2/1963 | Doran | 15/309.1 X |
| 3,735,702 | | 5/1973 | Kossak . | |
| 3,737,940 | * | 6/1973 | Moestue et al. | 101/425 X |
| 4,015,307 | | 4/1977 | Kossak . | |
| 4,372,760 | | 2/1983 | Van Zantwyk . | |
| 4,757,763 | | 7/1988 | MacPhee et al. . | |
| 4,972,780 | | 11/1990 | Gasparrini et al. . | |
| 5,010,819 | | 4/1991 | Uribe et al. . | |
| 5,086,701 | | 2/1992 | Gasparrini et al. . | |
| 5,107,764 | | 4/1992 | Gasparrini . | |
| 5,109,770 | | 5/1992 | Uribe et al. . | |
| 5,265,537 | | 11/1993 | Gasparrini et al. . | |
| 5,277,111 | | 1/1994 | Uribe et al. . | |
| 5,303,652 | | 4/1994 | Gasparrini et al. . | |
| 5,322,015 | | 6/1994 | Gasparrini . | |
| 5,836,044 | * | 11/1998 | Sinnett et al. | 15/309.1 |

OTHER PUBLICATIONS

"Turbo Surface Treatment System"—D& R Engineering.

* cited by examiner

*Primary Examiner*—Chris K. Moore
(74) *Attorney, Agent, or Firm*—Lathrop & Clark LLP

(57) ABSTRACT

A track assembly allows the placement of a pair of web cleaning devices on either side of a paper web moving upwardly through the floor of a press. The track assembly facilitates mounting and rapid removal of web cleaning buffs from beneath a press. A docking plate is installed on the operator side of the press, and a pivotally mounted flip plate is installed on the drive side of the press. A pair of tracks are mounted on either side of the web slot and extend between the docking plate and the flip plate. The tracks inter-fit with the docking plate and are clamped to the flip plate. A removable ramp can be temporarily attached to the drive side of the tracks to allow the cleaning assemblies to be moved up the ramp and positioned on each of the tracks.

13 Claims, 8 Drawing Sheets

WEB CLEANER TRACK ASSEMBLY

CROSS REFERENCES TO RELATED APPLICATIONS

STATEMENT AS TO RIGHTS TO INVENTIONS MADE UNDER FEDERALLY SPONSORED RESEARCH AND DEVELOPMENT

BACKGROUND OF THE INVENTION

The present invention relates to web presses in general, and to devices for cleaning a moving web in particular.

Paper is manufactured of fibers, typically of cellulose fibers made from wood. The fibers are formed into a sheet or web of paper which is pressed, dried, and wound onto a jumbo reel. Reels sized for printing newspaper are split from the jumbo reel and supplied to newspapers for printing.

A certain amount of dust, mainly loose cellulose fibers, is attached to the surfaces of the web as it is supplied to the presses, and this loose fiber tends to accumulate on roll surfaces and blankets within the press. In offset lithographic printing, the primary process used for newspaper printing, an oil-based ink is repelled from wetted portions of the printing plates. The cellulose fiber dust readily becomes wet and hence prevents ink from being properly applied to the paper. The buildup of loose fibers requires periodic cleaning of the press, reducing press availability and increasing the cost of press time.

Web cleaners have been developed to pre-clean paper. These cleaners include vacuum, air knife, and tack cleaners. One type of cleaner employs counter-rotating cleaning rolls which have stacks of canvas disks mounted on shafts and positioned on either side of the web to be cleaned. The rolls rotate counter to the direction the web is traveling and are positioned to create a boundary layer which penetrates the web boundary layer, to thereby strip off dust and fiber particles which are then removed by vacuum from the cleaning rolls. Web cleaners including rotating cleaners are relatively easily employed in presses designed for higher grades of printing such as magazines and books where the paper is fed into the press from front or back. Newspaper printing, however, will often utilize many webs, with each press typically having a web fed from beneath. The only suitable location for locating a web cleaner is above the press floor in the archway beneath the press. However, this space must be kept clear for threading the web, removal of inking rolls and access during a paper break.

What is needed is an apparatus for cleaning a web as it is fed from beneath a newsprint press.

SUMMARY OF THE INVENTION

The track assembly of this invention allows the placement of a pair of web cleaning buffs on either side of a paper web moving upwardly through the floor of a press. The track assembly facilitates mounting of the web cleaning buffs within the press archway, as well as rapid removal from the press archway without the use of tools. The frame of a press unit creates an arch overlying a press floor. The press floor, which may be constructed of removable metal plates, has a web slot through which a paper web is drawn from a press basement up into the press rollers. The track assembly has a docking plate which is installed on the operator side of the press. The docking plate extends vertically from the press floor and can be bolted into existing press floor attachment bolt holes in some presses. The docking plate bolts extend through the deck to attach both the docking plate and the deck to underlying structure. On the opposite side of the press, a pivotally mounted flip plate is bolted at a location spaced from the slot through which the paper web is drawn. Lightweight aluminum extrusions are used to form a pair of tracks which are mounted on either side of the web slot and which extend between the docking plate and the flip plate. Each aluminum extrusion has a pair of extensions on the operator side which slide into the docking plate. On the drive side, a pair of drive side extensions are linked to a cross structure which incorporates a screw clamp. A slot in the pivotally mounted flip plate allows the flip plate to slide over a clamping bracket and engage the end of the extrusion and to be clamped to the drive side of the extrusion by rotating a bolt forming a screw clamp. The tracks formed by the aluminum extrusions are fixed to the press floor by a single bolt on each track screw clamp, which clamps the extrusions to the pivotal flip plate, the opposite end of the extrusions engage the docking plate so preventing pivoting of the extrusions on the flip plate.

A removable ramp can be hooked to a bar above the cross structure containing the screw clamp on the drive side of the press.

Cleaning assemblies are moved up a removable ramp and positioned on each of the tracks formed by the extrusions. Each cleaning assembly has a web cleaning buffing cylinder mounted on pneumatic actuators in a vacuum plenum. The plenum and actuators are in turn mounted to a frame. An operator side carriage roller assembly and a drive side carriage roller assembly are mounted beneath the frame. The operator side carriage roller assembly comprises a bracket mounted for rotation about a vertical swivel axis. This bracket supports a shaft for rotation. The shaft supports for rotation a pair of guide wheels which straddle the extrusion, and a pair of rollers which ride on the top of the extrusion. The operator side carriage roller assembly bracket has a tang which mates with the docking plate. The drive side carriage roller assembly has a bracket rigidly mounted to the cleaner frame. This bracket supports a shaft for rotation, and the shaft supports a pair of guide wheels which straddle the extrusion, and a pair of rollers which ride on the top of the extrusion. The drive side carriage roller assembly supports a clamp operated by a palm nut which causes a pair of jaws to clamp the sides of the extrusion.

The cleaning cylinders are driven by motors mounted to the cleaner frames. Each cleaning assembly has an electrical power cord, two quick-disconnect pneumatic hoses and bayonet mounted vacuum hose, all attached from the operator side of the press. The buffing cylinder, buffing cylinder housing, and the cleaner frame are conventional. The pneumatic mounting of the buffing cylinder allows rapid retraction of the buffing cylinder from the web when a web splice occurs or when a web is fed through the press. The track assembly allows the web cleaners and track to be completely removed, except for the flip plate, from the archway of a press in less than three minutes, making practical web cleaning on bottom fed newsprint presses.

It is an object of the present invention to provide a system for rapidly installing and removing a web cleaner from the archway of a printing press.

It is a further object of the present invention to reduce the cost of operating certain presses which heretofore have not been able to practically accommodate a web cleaner.

It is another object of the present invention to provide an easily installed and removed track system beneath a printing press.

It is yet further object of the present invention to provide an apparatus and method of reducing contamination in the ink train, dampeners and blankets in a bottom fed newspaper press.

It is a still further object of the present invention to provide a method and apparatus for enhancing print quality on bottom fed newspaper presses.

Further objects, features and advantages of the invention will be apparent from the following detailed description when taken in conjunction with the accompanying drawings.

DESCRIPTION OF THE PREFERRED EMBODIMENTS

Figure 1:
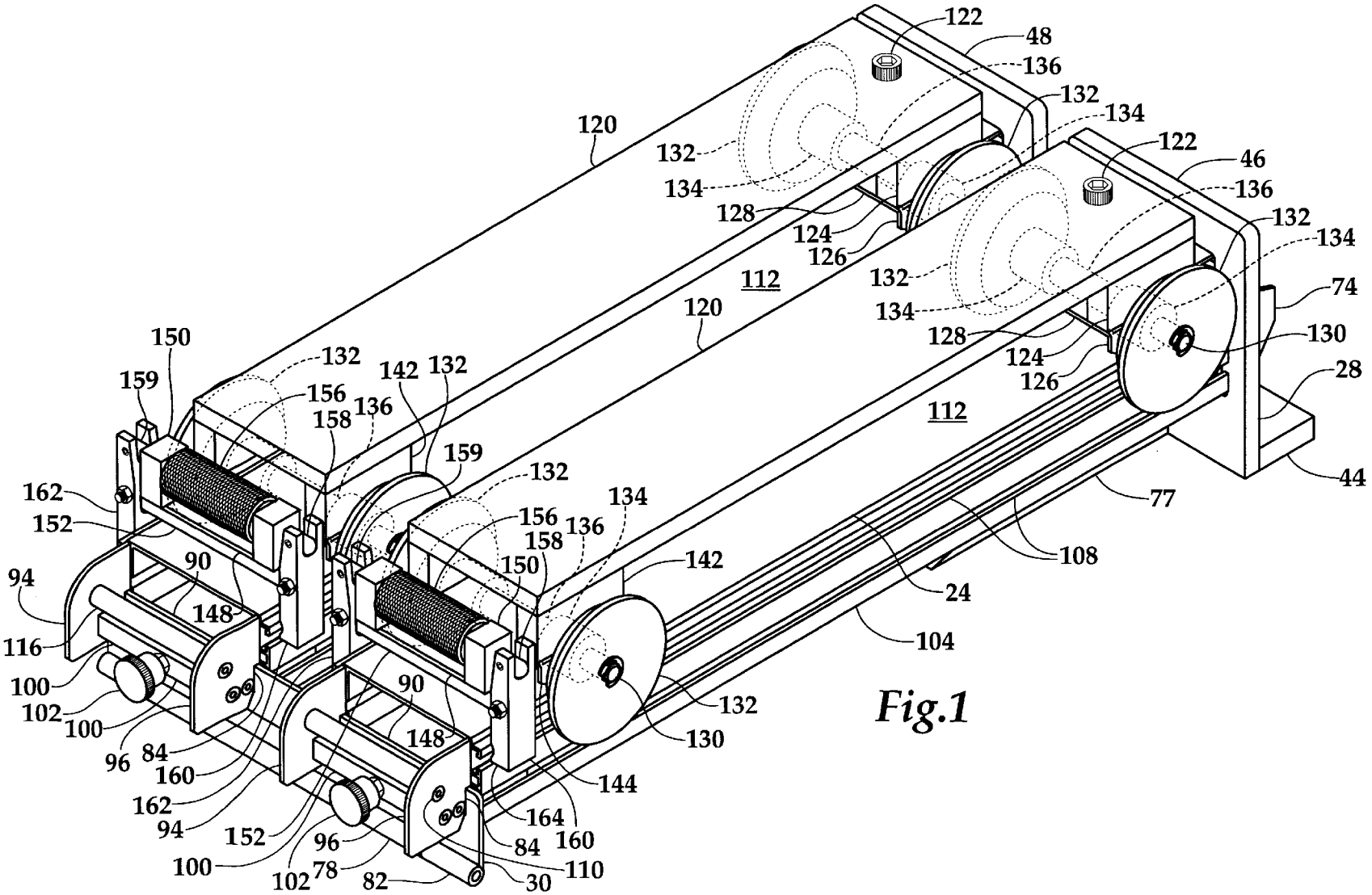
FIG. 1 is an isometric view of the track assembly and roller mounts for the cleaning assembly of this invention.
Figure 2:
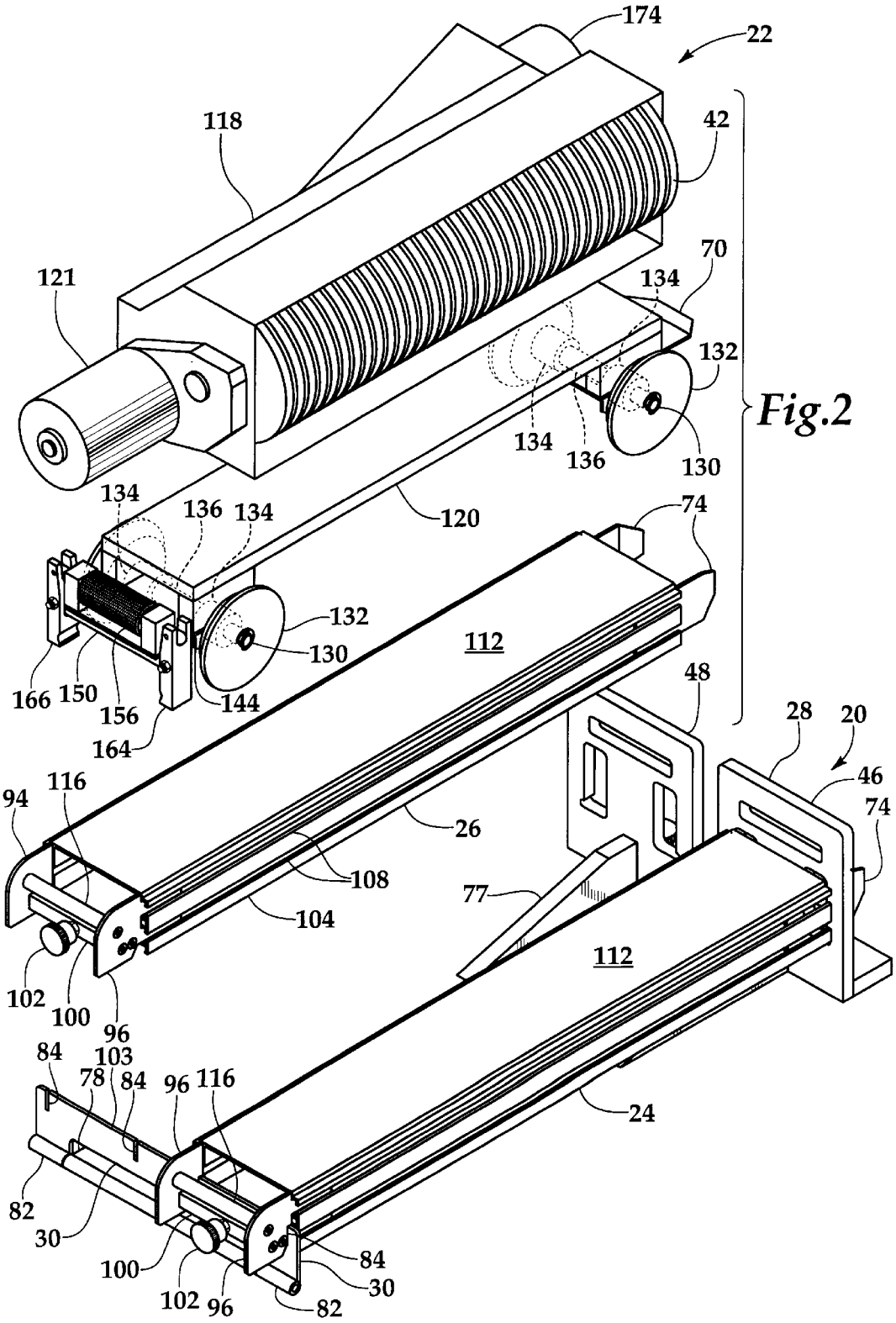
FIG. 2 is an exploded isometric view of the track, roller mount and cleaning assembly of this invention
Figure 3:
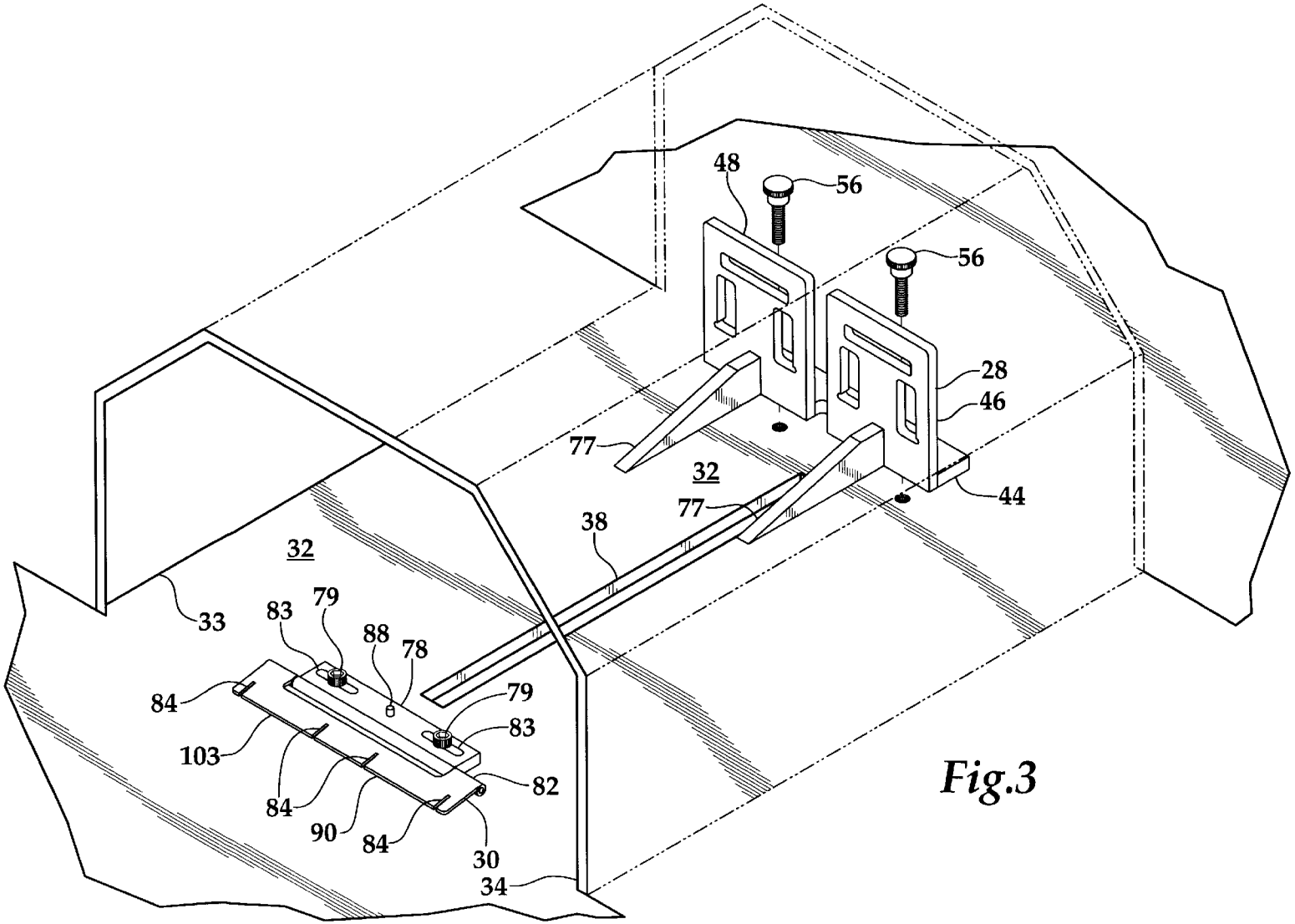
FIG. 3 is a partly exploded isometric view of the docking plate and flip plate of FIG. 1 shown in the archway of a printing press.
Figure 4:
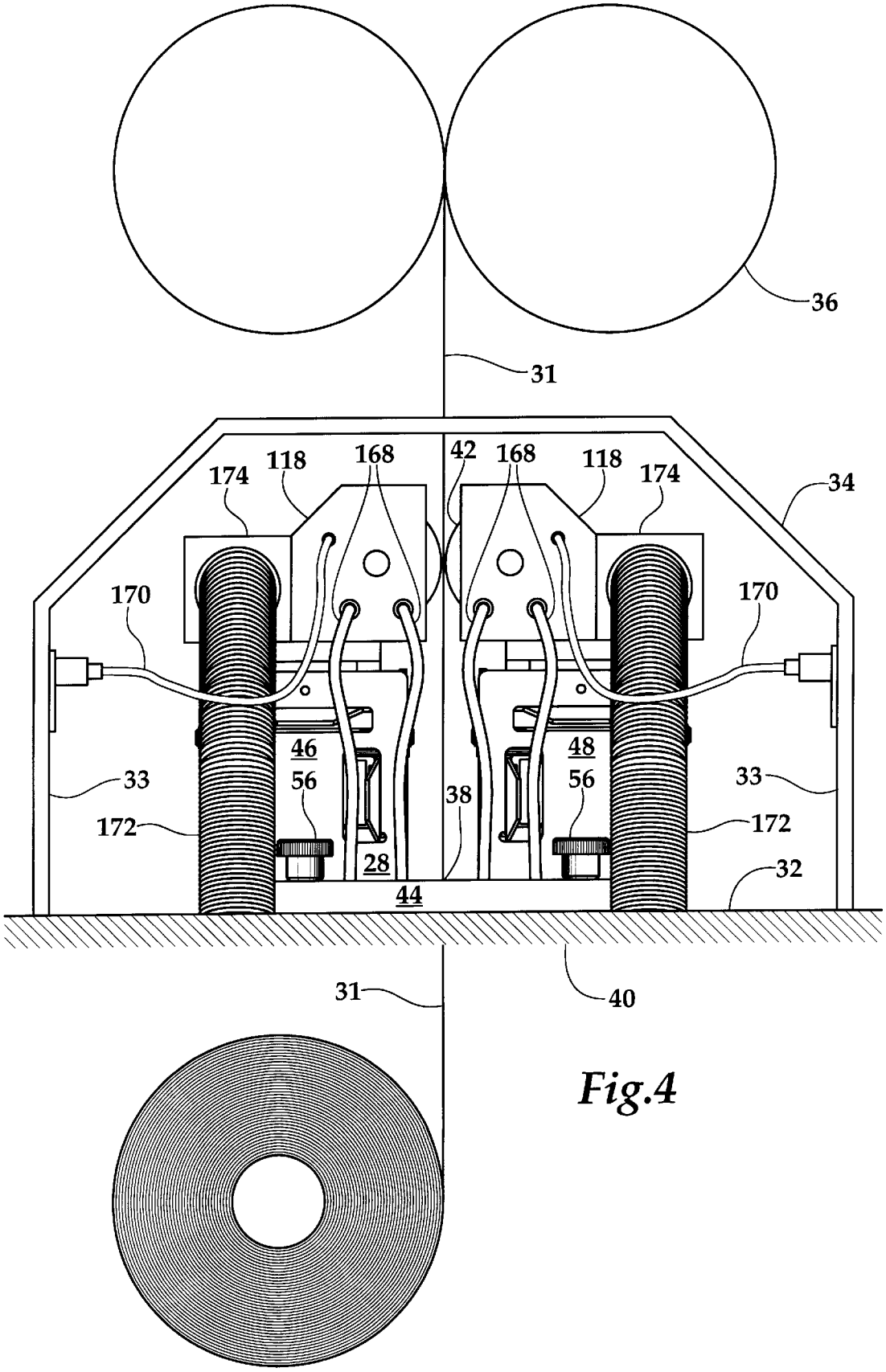
FIG. 4 is a schematic end elevational view of the track assembly and roller mounted cleaning assembly of FIG. 1 mounted within the archway of a printing press.
Figure 6:
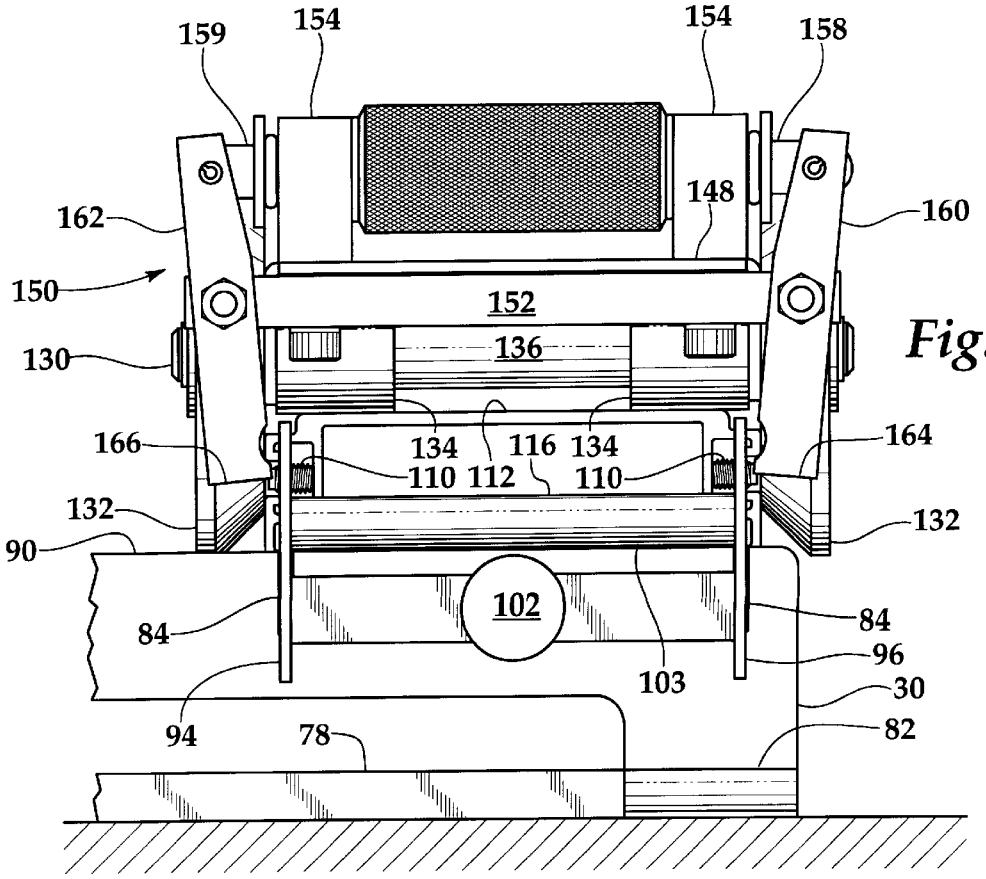
FIG. 6 is an end elevational drive side view of the palm nut clamp of FIG. 5, shown engaged with the track.
Figure 7:
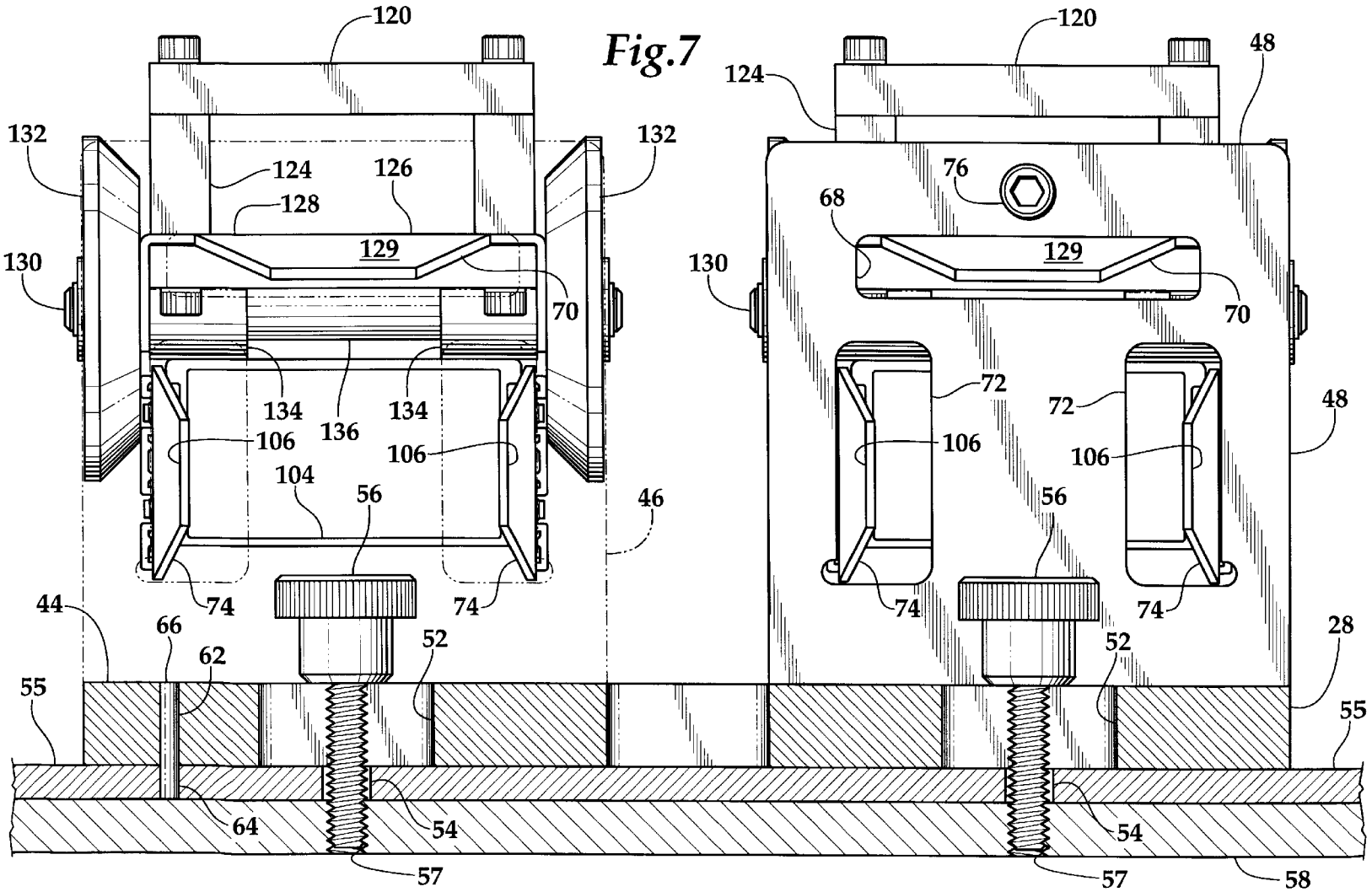
FIG. 7 is an end elevational operator side view of the apparatus of FIG. 1, with the left docking plate shown partially in phantom.
Figure 8:
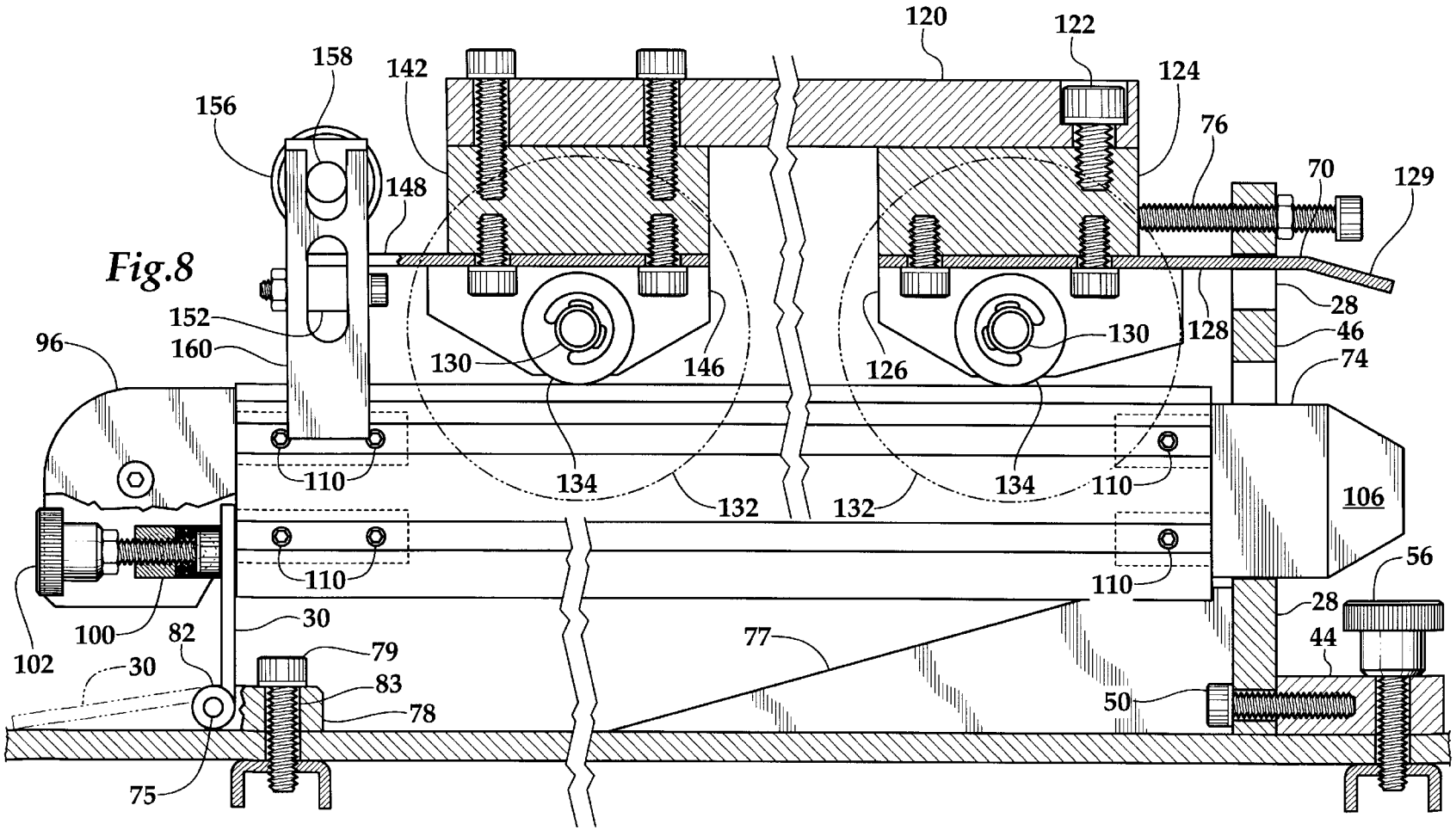
FIG. 8 is a cross-sectional view, partly broken away in section, of the track assembly and roller mounts of FIG. 1.
Figure 9:
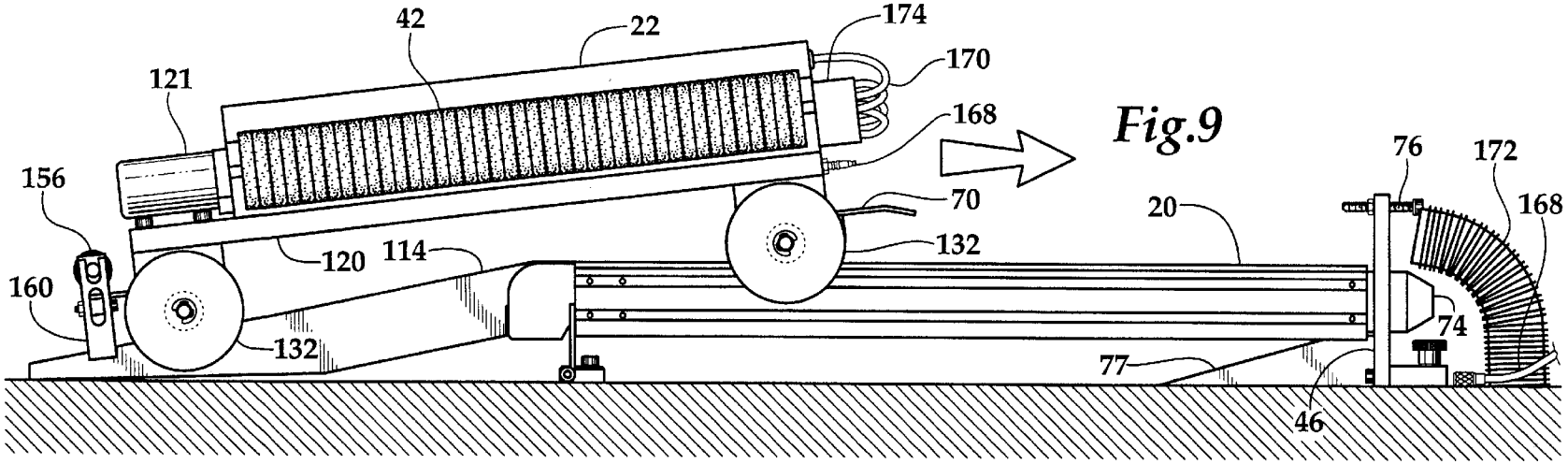
FIG. 9 is a schematic side elevational view of the cleaning assembly of FIG. 2 rolling onto the track.
Figure 10:
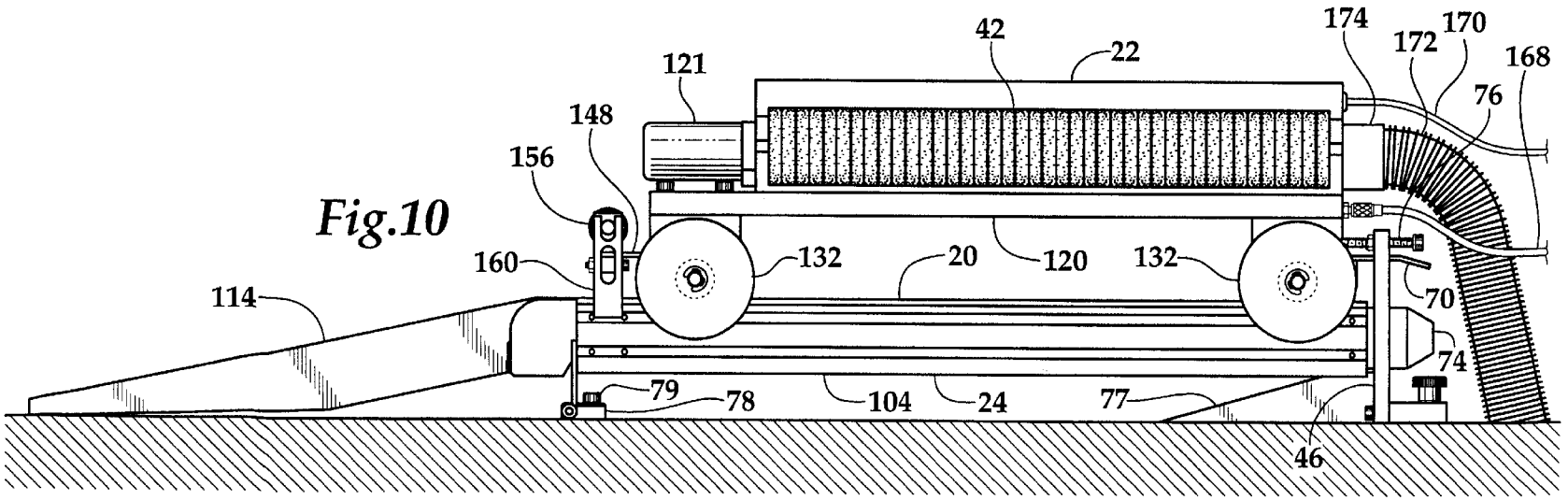
FIG. 10 is a schematic side elevational view of the cleaning assembly installed onto the track.

Referring more particularly to FIGS. 1–10, wherein like numbers refer to similar parts, a track assembly 20 is shown with a cleaning assembly 22 mounted thereto in FIG. 10. The track assembly 20, as best shown in FIGS. 1, 2 and 8 has a first track 24 and a second track 26 mounted between a docking plate 28 and a flip plate 30 which are mounted to a press floor 32 within an archway 33 formed beneath the frame 34 of a press 36, as shown in FIGS. 3 and 4. The first track 24 and second track 26 are positioned on either side of a slot 38 in the press floor 32 through which a paper web 31 is drawn. The length of the track assemblies 20 and the cleaning assemblies 22 will vary depending on the size of the press to which the system is mounted. For illustrative purposes, in the drawings the overall length of the system has been reduced. A typical newsprint web may be fifty to fifty-five inches wide, with a track for a 54-inch web being about 83 inches long.

The press archway 33 beneath the frame 34 of the press 36 where the web 31 is fed upwardly to the press from the press basement 40, has usually not been considered a possible location of ancillary equipment, because of the need to keep this space clear so as to facilitate clearing paper breaks, and gaining access to the ink rolls from beneath the press. However, this space is easily accessed and would provide an advantageous position for a web cleaning system where dust can be removed from the web prior to entering the printing rollers and blankets. To be practical however, a way of rapidly installing and removing the cleaning system and its support system must be available, or the access functions of the archway would be unduly compromised.

Complicating the installation of cleaning equipment is the tight tolerance called for between the cleaning brushes/buffing rolls 42 and the web 31, as shown in FIG. 4. The brushes are composed of buffing disks typically of cloth material which are frayed to form a soft outer surface which is then worn in against a moving web. To effectively clean the web, an interaction between the cleaning rolls must be uniformly established with the boundary layer of air which attaches to a moving web. The boundary layer which attaches to the paper web may be only a small fraction of an inch thick. Initial alignment between the buffs and the web can be accomplished by wearing the buffs slightly against the web to create a self-aligning system for close tolerance engagement of the web. However, once the web cleaning brushes/buffs are aligned with the web it is important that the web cleaner be returned to the same position after removal and re-installation so that the boundary layer created by the rotating buffing wheel interacts with the boundary layer attached to the paper web.

Repeatable alignment, combined with ease of removal, results from cooperative functioning between the docking plate 28 and the flip plate 30 forming a mounting means which is precisely positioned with respect to the web slot 38, the tracks 24, 26, and the cleaning assembly 22.

In practice, the cleaning assembly may be rapidly installed, without the need for tools. The cleaning assembly is also rapidly removed from within the archway without the use of tools, to facilitate access to the archway.

The docking plate 28 incorporating two engagement plates 46, 48, as shown in FIGS. 3, 7, and 8, comprises a mounting plate 44 to which an upwardly extending first docking engagement plate 46, and a second docking engagement plate 48 are mounted by Allen head screws 50. As shown in FIG. 7, the mounting plate 44 has two slots 52 which are positioned over holes 54 in a deck plate 55. Knob bolts 56 are positioned in the slots 52 and engage threaded holes 57 in the structure 58 which supports the deck plates 55. The docking plate 28 is mounted by the mounting plate 44 by hand tightening the knob bolts 56.

After the docking plate 28 has been aligned the first time, an alignment hole 62 is drilled as shown in FIG. 7 the hole 62 extends into the deck plate 55 in a matching hole 64. The docking plate 28 is removed from the deck plate 55 and a roll pin 66 is fixed within the hole 62 to extend downwardly into the deck plate hole 64. The hole 64 is enlarged slightly to produce a slip fit between the pin 66 and the hole 64 in the deck plate 55. Thus when the docking plate 28 is repositioned, the pin 66 assures precise alignment with the original position.

Each of the first docking engagement plate 46 and the second docking engagement plate 48 has three slots formed therein. The upper slot 68 extends horizontally and receives a horizontal alignment tongue 70 which protrudes from a cleaning assembly 22. Two vertical slots 72 are positioned below each upper slot 68 which receive two vertical tongues 74 projecting from each of the tracks 24, 26. A single centrally located adjustment bolt 76 is located above each horizontal slot 68. The adjustment bolts 76, as shown in FIG. 8, position the cleaning assemblies 22 along the tracks 24, 26. Fifteen degree ramps 77 are centrally bolted to the docking engagement plates 46, 48 opposite the mounting plate 44 as shown in FIGS. 2, 3, and 8–10. The ramps 77 facilitate sliding the tracks 24, 26 and the track vertical tongues 74 into engagement with the mounting plates 44, 46 of the docking plate 28.

Whereas the docking plate 28 is readily removable by un-tightening the knob bolts 56 and the flip plate 30 is permanently installed with bolts 79 as shown in FIGS. 3 and 8. The flip plate 30 is pivotally mounted to an anchor plate 78 by pins 75 which screw into short tubular shafts 82 which are welded to the bottom of the flip plate 30. The anchor plate 78 has two horizontal slots 83 which allow side to side adjustment of the position of the anchor plate 78. The bolts 79 lock the anchor plate 78 and so the flip plate 30, to the press floor 32 . The flip plate 30 is normally left in place when the track assembly 20 is removed from the archway 33, the flip plate being pivoted away from the slot 38 to overlie the press floor 32, as shown in FIG. 3. In the folded condition, the flip plate 30 extends only about one-half inch above the press floor 32. Should removal at some time be necessary, an alignment pin 88 may be employed, similar to the alignment pin 66 used to locate the docking plate 28.

As best shown in FIG. 2, the upper edge 90 of the flip plate 30 has two pair of upwardly opening slots 84 which cooperate with the tracks 24, 26 when the flip plate 30 is pivoted to be perpendicular to the anchor plate 78. The drive side of each track 24, 26 is terminated by a clamp supported bracket 96 engaged with two protruding sides 94 of each track respectively. The bracket sides 94 comprise plates which are received within the slots 84. A rectangular bar 100 extends between the sides 94, and supports a knob-headed bolt 102 which forms a screw clamp, the threaded bolt clamping a portion 103 of the flip plate 30 between slots 84 against the end of the aluminum extrusion 104 which forms the structure of the tracks 24, 26.

Each track 24, 26 is locked in place by turning a single knob-headed bolt 102 by less than a single turn. The attachment of the tracks 24, 26 to the flip plate 30 prevents any motion except rotation about the pivot axis defined by the pins 75 which connect the flip plate 30 to the anchor plate 78. However, the engagement of the vertical tongues 74 on the operator side of the tracks 24, 26 with the vertical slots 72 of the engagement plates 46, 48 prevents movement, particularly rotation of the tracks 24, 26, thus locking the tracks in place when they are clamped to the flip plate 30.

The arrangement of the docking plate 28 and flip plate 30 is such as to facilitate a single person installing the tracks 24, 26 with minimum effort. The docking plate 28 is installed from the operator side of the machine by simply installing two hand tightened bolts 56. From the operator side of the press, the tracks 24, 26 may be easily aligned and engaged with the engagement plates 46, 48 making up docking plate 28 by inserting the vertical tongues 74 into the vertical openings 72 in the engagement plates. The tongues 74 have a bent portion 106 which provides a guiding tapered surface which facilitates easy and rapid docking with the engagement plates 46, 48. To limit the lifting required, the installer can slide the ends of the tracks up the narrow ramps 77 positioned beneath the horizontal openings 68. Once the tracks are engaged with the docking plate 28, the flip plate 30 is rotated into a vertical position and the flip plate slots 84 are engaged with the sides 94 of the clamp support brackets 96. The clamp bolt 102 is then tightened, engaging the flip plate 30 against the end of the extrusion 104.

Figure 5:
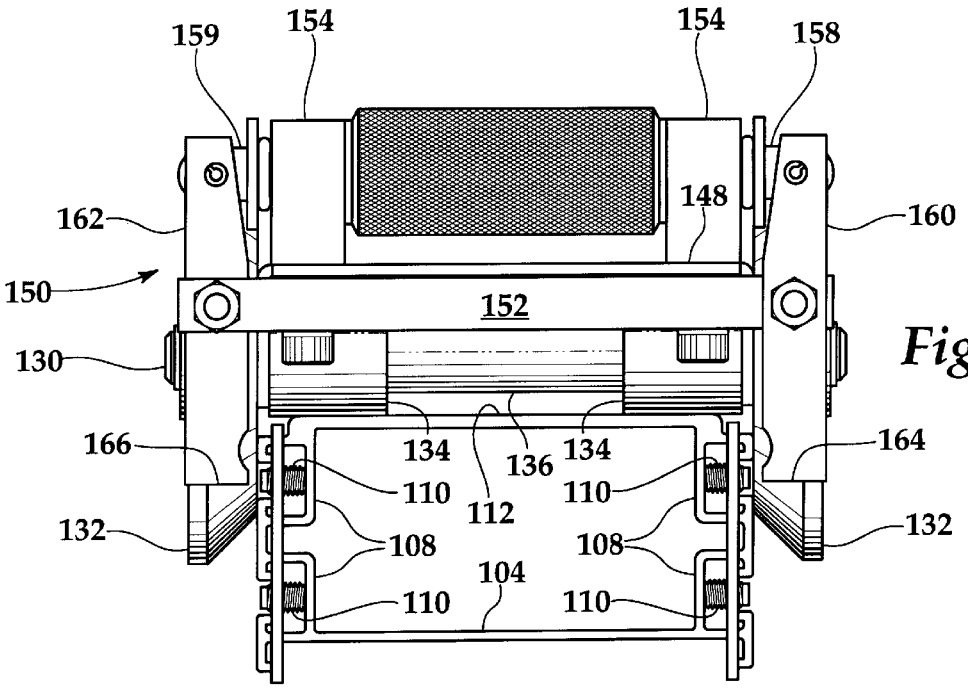
FIG. 5 is an end elevational drive side view of the palm nut clamp of the assembly of FIG. 1 shown disengaged from the track.

The extrusion 104, as shown in FIGS. 5 and 8, has pairs of parallel recessed grooves 108 on either side which allow set screws 110 to lock the sides 94 of the clamping bracket 96 and the vertical tongues 74 to the extrusion 104 to form the tracks 24, 26.

Once the tracks 24, 26 are installed, the cleaning assembly 22 may be readily positioned onto the upper surfaces 112 of the tracks by rolling each cleaning assembly 22 up a positionable ramp 114 as shown in FIG. 9. The ramp 114 is a sheet metal piece which engages with a bar 116, best shown in FIGS. 2 and 6, which extends between the sides 94 of the clamping bracket 96 just above the rectangular bar 100 which forms the screw clamp. Only a single ramp 114 may be supplied, which may be sequentially used to install or remove first one of the cleaning assemblies, and then the other.

Each cleaning assembly 22, as shown in FIGS. 2, 9 and 10, has a web cleaning buffing cylinder roll 42 mounted on pneumatic actuators (not shown) to a vacuum plenum 118. The plenums 118 and pneumatic actuators (not shown) are mounted to a frame 120, best shown in FIGS. 2 and 8. A motor 121 is mounted to the frame 120 and the vacuum plenum 118.

The frame 120, as best shown in FIG. 8, is pivotally connected by a bolt 122 to an operator side carriage spacer 124 which in turn is connected to an operator side carriage roller assembly 126. The roller assembly 126 has a metal frame 128 which incorporates the horizontal tongue 70. The tongue 70 engages a horizontal slot 68 in one of the two engagement plates 46, 48. The tongue 70 has a bent portion 129 which guides the tongue into the horizontal slot 68. The tongue 70 may be provided with a hole to receive a hook or cable for ease in maneuvering the assembly. The metal frame 128 supports a shaft 130 for rotation as best shown in FIG. 1 and FIG. 7. Mounted on the shaft 130 adjacent to the ends of the shaft are a pair of guide wheels 132 which are mounted to the shaft 130. The wheels 132 capture the sides of the extrusion 104 positioning the cleaning assembly 22 transversely with respect to the tracks 24, 26. The guide wheels 132 also support the cleaning assembly 22 when the assembly engages the floor surrounding the press 36 as the cleaning assembly is moved from storage into position on the tracks 24, 26.

The shaft 130 also supports two roller 134 which are mounted by bronze bushings (not shown) to the shaft and are spaced apart by a tube 136 which extends along the shaft between the rollers 134. The rollers 134 roll on the upper surface 112 of the tracks 24, 26 formed by extrusions 104 to permit the cleaning assembly 22 to be moved into position on the track. The pivotal mounting of the frame 120 by the bolt 122 allows the operator side carriage assembly 126 to steer the cleaning assembly 22 as it is rolled to and away from the press 36.

The frame 120, as shown in FIG. 8, is also fixedly connected to a drive side carriage spacer 142 which in turn is connected to a drive side carriage roller assembly 144. The assembly has a metal frame 146 which incorporates a drive side extension 148 to which a two arm clamp 150 is attached. The metal frame 146 also rotatably supports a shaft 130 as described with respect to the operator side carriage assembly 126, and as shown in FIG. 1 and FIG. 7. Again a pair of guide wheels 132 are mounted by bronze bushings (not shown) on the shaft 130 adjacent to the shaft ends by bronze bushings (not shown). Again the guide wheels 132 capture the sides of the extrusion 104 and position the cleaning assembly 22 transversely with respect to the tracks 24, 26. The guide wheels 132 support the cleaning assembly 22 when the assembly engages the floor surrounding the press 36 as the cleaning assembly is moved from storage into position on the tracks 24, 26.

The shaft 130 also supports two rollers 134, the rollers are also mounted by bronze bushings (not shown) to the shaft and are spaced apart by a tube 136, shown in FIG. 1, which extends along the shaft between the rollers 134. The rollers 134 roll on the upper surface 112 of the tracks 24, 26 formed by the extrusions 104.

The cleaning assemblies 22 are positioned on the tracks 24, 26 by the horizontal tongues 70 which engage the slots 68, by the adjustment bolts 76, and by clamps 150, best shown in FIGS. 5 and 6. The cleaning assemblies 22 are clamped to the aluminum extrusions 104 forming the tracks 24, 26. Each clamp 150 has a fulcrum bar 152 which is bolted through the drive side metal frame 146 to palm nut spacers 154. The spacers 154 support a palm nut 156 which engages a right hand threaded shaft 158 and a left hand threaded shaft 159. The left and right handed shafts are pinned to a right jaw 160 and a left jaw 162 which are also pinned by bolts to the fulcrum bar 152. Rotation of the palm nut 156 closes or opens the ends 164, 166 of the jaws 160, 162 causing them to lock against or release the sides of the extrusions 104.

When the cleaning assembly 22 is installed, as shown in FIG. 4 and FIG. 10, two compressed air lines 168 are connected to each cleaning assembly 22 to actuate the motion of the buffing rolls 42 toward and away from the web 31. A power cord 170 connects to each motor 121, and a vacuum duct 172 connects vacuum to plenum nipples 174 on the vacuum plenums 118.

It should be understood that various web cleaning devices could be used but preferably a web cleaner head such as available from Dee Paul Graphic Services, South Gate Calif. 90280.

It should be understood that the aluminum extrusions 104 might be replaced with extrusions of a different cross-section, or even a solid shaft, or several shafts, and by way of example the shafts could be either round or rectangular, these various extrusions or shafts form means for supporting and guiding a web cleaner. The means for moving and guiding the cleaning assemblies 22 along the tracks could depend on which of the foregoing track designs are chosen and could use various wheels, slip bearings, roller bearings, tapered bearings, ball bearings, low friction sliding bearings, air bearings, etc. The docking plate 28 could employ a variety of geometric shapes to create an easily engaged sliding mechanism which blocks the tracks and cleaning assembly against vertical and horizontal motion while allowing axial motion along the direction of the tracks, for example tapered cones, pyramids, or wedges. The flip plate could be clamped to the drive side of the tracks by any conventional clamping mechanism.

It should be understood that some presses will not have actual floor plates, in which case the flip plate and docking plate may be mounted to portions of the press frame, which form an effective floor. Moreover, alternatively, the tracks may be formed as an integral part of the press deck plates, for example, by laser cutting parallel slots in the deck plates on opposite sides of the paper slot 38. Alternatively, the track may be mounted directly to the press deck by way of pins which extend downwardly from the tracks to engage with deck plate holes or slots or similar locating features, thereby eliminating the need for either docking plates or flip plates to locate the track. Transverse placement of the web cleaners on the tracks may be accomplished by additional locating features permanently mounted to the track extrusions, these locating features may be an arrangement of pins and holes, or plates which extend upwardly from the track extrusions themselves. It should be noted that other types of cleaning assemblies may also be employed with the apparatus of this invention, for example tack, vacuum, or air knife cleaners.

It is understood that the invention is not limited to the particular construction and arrangement of parts herein illustrated and described, but embraces such modified forms thereof as come within the scope of the following claims.

I claim:

1. A web cleaner and track system for positioning the web cleaner in an archway beneath a printing press comprising:

a docking plate extending from a press floor perpendicular to but not obstructing a slot through which a paper web is drawn through the press floor;

a pivotally mounted flip plate mounted to a bracket mounted to the press floor, the flip plate being pivotal to a position in spaced parallel relation to the docking plate, the flip plate not obstructing the slot through which the paper web is drawn;

a first track extending between the docking plate and the flip plate in parallel relation with the slot;

a second track extending between the docking plate and the flip plate opposite the first track in spaced parallel relation with the slot;

a first cleaner mounted to a first frame, the frame being supported between a first swivel mounted carriage roller assembly, and a second carriage roller assembly, the first carriage roller assembly having a tongue slidably engagable with the docking plate and a means for sliding and guiding the first carriage roller assembly on the first track, the second carriage roller assembly having a self centering clamp engagable to lock the cleaner to the first track, the second carriage roller assembly having means for sliding and guiding the second carriage roller assembly on the first track; and a second cleaner mounted to a second frame, the second frame being supported between a first swivel mounted carriage roller assembly, and a second carriage roller assembly, the first carriage roller assembly having a tongue slidably engagable with the docking plate and a means for sliding and guiding the second frame first carriage assembly on the second track, the second frame second carriage roller assembly having a self centering clamp engagable to lock the second cleaner to the second track, the second frame second carriage roller assembly having means for sliding and guiding the second frame second carriage on the second track.

2. The apparatus of claim 1 wherein the first track and the second track are rectangular extrusions, and wherein the means for sliding and guiding the first and second carriage roller assembly comprises wheels which straddle the extrusions and wheels which ride on an upper surface of the excursions.

3. A track system for positioning a web cleaner on both sides of a paper web in an press archway beneath a printing press comprising:

a press floor;

a press, defining an archway above a press floor;

a paper web passing upwardly through a slot in the press floor through the archway and into the press;

a first plate fixedly mounted to and extending from the press floor perpendicular to and adjacent a first end of the slot but not obstructing the slot;

a second plate mounted to the press floor, in spaced parallel relation to the first plate, the second plate adjacent to a second end of the slot opposite to the first end and not obstructing the slot;

a first track having a first end slidably engaged with the first plate positioning the first end with respect to the slot, the first track having a second end opposite the first end, the second end being releasably clamped to the second plate to position the second end and thereby the first track with respect to the slot, the first track having a means for guiding a web cleaner onto the first track, and a means for supporting the web cleaner on the first track in spaced parallel relation to the slot; and a second track having a first end slidably engaged with the first plate positioning the first end with respect to the slot, the second track having a second end opposite the first end, the second end being releasably clamped to the second plate to position the second end and thereby the second track with respect to the slot and in spaced parallel relation to the first track, the second track having a means for guiding a web cleaner onto the second track, and a means for supporting the web cleaner on the second track in spaced parallel relation to the slot and the second track.

4. The apparatus of claim 3 wherein the second plate is pivotally mounted to a bracket mounted to the press floor so it may be collapsed against the press floor when the first and second tracks are removed.

5. The apparatus of claim 4 wherein the second plate has portions forming a plurality of pairs of slots, the a second portion being defined between each pair of slots, the slots allowing said second portions of the second plate to slidably engage with the first track, the first track having a screw forming a releasable clamp, the screw engaging one of said second portions.

6. The apparatus of claim 4 further comprising two web cleaner assemblies, each cleaner assembly comprising a web cleaner mounted to a frame, the frame being supported on a first carriage which incorporates a means for engaging the means for guiding and a means for riding on the means for supporting, the first carriage slidably engaging with the docking plate, the frame being supported on a second carriage which incorporates a means for engaging the means for guiding and a means for riding on the means for supporting, the second carriage in releasable clamping engagement with the second plate.

7. A track system for positioning a web cleaner on both sides of a paper web in a press archway beneath a printing press comprising:

a press floor and floor support structure;

a press, defining an archway above the press floor and floor support structure;

a paper web passing upwardly through a slot in the press floor and floor support structure through the archway and into the press;

a first track, the first track having structure for positioning a first web cleaner in the archway on the first track in spaced parallel relation to the slot; and a second track, the second track having structure for positioning a second web cleaner in the archway on the second track in spaced parallel relation to the slot.

8. A track system for removably positioning a web cleaner on both sides of a paper web in a press archway beneath a printing press having a paper web extending upwardly from beneath the press, the track system comprising:

a first track positioned in the press archway substantially parallel to the paper web;

a second track positioned in the press archway substantially parallel to the first track;

a first web cleaning assembly mounted on the first track for movement along the first track; and a second web cleaning assembly mounted on the second track for movement along the second track, wherein the first web cleaning assembly and the second web cleaning assembly may be completely separated from the first track and the second track and fully removed from the press archway.

9. The apparatus of claim 8 further comprising:

a first docking plate releasably secured to the press and having portions defining openings which receive first ends of the first track and the second track; and a second docking plate releasably secured to the press and releasably securable to a second end of the first track and the second track, the first docking plate and the second docking plate serving to releasably secure the first track and the second track in position within the press archway, and to facilitate ready removal of the tracks from the press archway without the use of tools.

10. The apparatus of claim 8 wherein the first web cleaning assembly and the second web cleaning assembly each include a plurality of rollers which ride on the one of the first track and the second track.

11. The apparatus of claim 8 wherein the first web cleaning assembly and the second web cleaning assembly each include a plurality of wheels which are spaced on either side of a track, and which are adapted to support the web cleaning assemblies when they are not supported by a track.

12. The apparatus of claim 8 further comprising a clamp connected to each of the cleaning assemblies, each clamp be adjustable to selectably secure a cleaning assembly to one of said tracks.

13. A track system for positioning a web cleaner on both sides of a paper web in an press archway beneath a printing press comprising:

a press floor;

a press defining an archway above the press floor;

a paper web passing upwardly through a slot in the press floor through the archway and into the press;

a first plate mounted to and extending from the press floor perpendicular to and adjacent a first end of the slot but not obstructing the slot;

a second plate mounted to the press floor, in spaced parallel relation to the first plate, the second plate adjacent to a second end of the slot opposite to the first end and not obstructing the slot;

a first track having a first end releasably engaged with the first plate, positioning the first track first end with respect to the slot, the first track having a second end opposite the first end, the second end of the track being releasably clamped to the second plate to position the second end of the track and thereby the first track with respect to the slot, the first track having portions which extend along the track to form a first guide;

a first web cleaner supported on the first track, and engaged with the first guide;

a second track having a first end releasably engaged with the first plate, thereby positioning the first end with respect to the slot, the second track having a second end opposite the second track first end, the second end of the second track being releasably clamped to the second plate to position the second end of the second track and thereby the second track with respect to the slot and in spaced parallel relation to the first track, the second track having portions which extend along the second track to form a second guide; and a second web cleaner mounted on the second track and engaged with the second guide.

* * * * *